United States Patent [19]

Tsubouchi et al.

[11] Patent Number: 4,840,745

[45] Date of Patent: Jun. 20, 1989

[54] FLUID COMPOSITION

[75] Inventors: Toshiyuki Tsubouchi; Kazuaki Abe; Hitoshi Hata, all of Sodegaura, Japan

[73] Assignee: Idemitsu Kosan Company Limited, Tokyo, Japan

[21] Appl. No.: 123,412

[22] Filed: Nov. 20, 1987

[30] Foreign Application Priority Data

Nov. 21, 1986 [JP] Japan ..... 61-278307

[51] Int. Cl.[4] ..... C10M 105/04

[52] U.S. Cl. ..... 252/73; 585/1; 585/20; 585/268; 585/269; 585/270

[58] Field of Search ..... 252/73; 585/1, 20, 268, 585/269, 270

[56] References Cited

U.S. PATENT DOCUMENTS

| | | | |
|---|---|---|---|
| 3,440,894 | 4/1969 | Hammann et al. | 252/52 R |
| 3,803,037 | 4/1974 | Wygant | 252/32.7 E |
| 3,925,217 | 12/1975 | Green et al. | 252/52 A |
| 4,371,726 | 2/1983 | Horita et al. | 585/3 |
| 4,609,481 | 9/1986 | Tsubouchi et al. | 252/73 |
| 4,704,215 | 11/1987 | Hata et al. | 252/32.7 E |

OTHER PUBLICATIONS

Dhein et al., "Effect of Molecular Structure on the Friction Behavior of Lubricating Fluids. I. Saturated Cyclic Compounds and Their Friction Behavior," Erdoel Kohle, Erdgas, Petrochem. 1982, 35(11), 518–25, (CA 98: 56718f).

Hentschel, "The Influence of Molecular Structure on the Frictional Behavior of Lubricating Fluids. Part 1. High Coefficients of Traction," J. Synth. Lubr. 1985, 2(2), 143–65, (CA 104: 53200n).

Bulletin De La Societe Chimique De France, No. 9, Y. Bahurel et al, pp. 3232–3242, 1969.

Bulletin De La Societe Chimique De France, No. 4, G. Descotes et al, pp. 1517–1524, 1973.

*Primary Examiner*—Robert A. Wax

*Attorney, Agent, or Firm*—Armstrong, Nikaido, Marmelstein, Kubovcik & Murray

[57] ABSTRACT

A stable fluid composition is provided by this invention which contains a cis-o-tercyclohexyl compound and a trans-o-tercyclohexyl compound at a weight ratio of 25:75–65:35. This composition is useful as a fluid for traction drive.

6 Claims, 1 Drawing Sheet

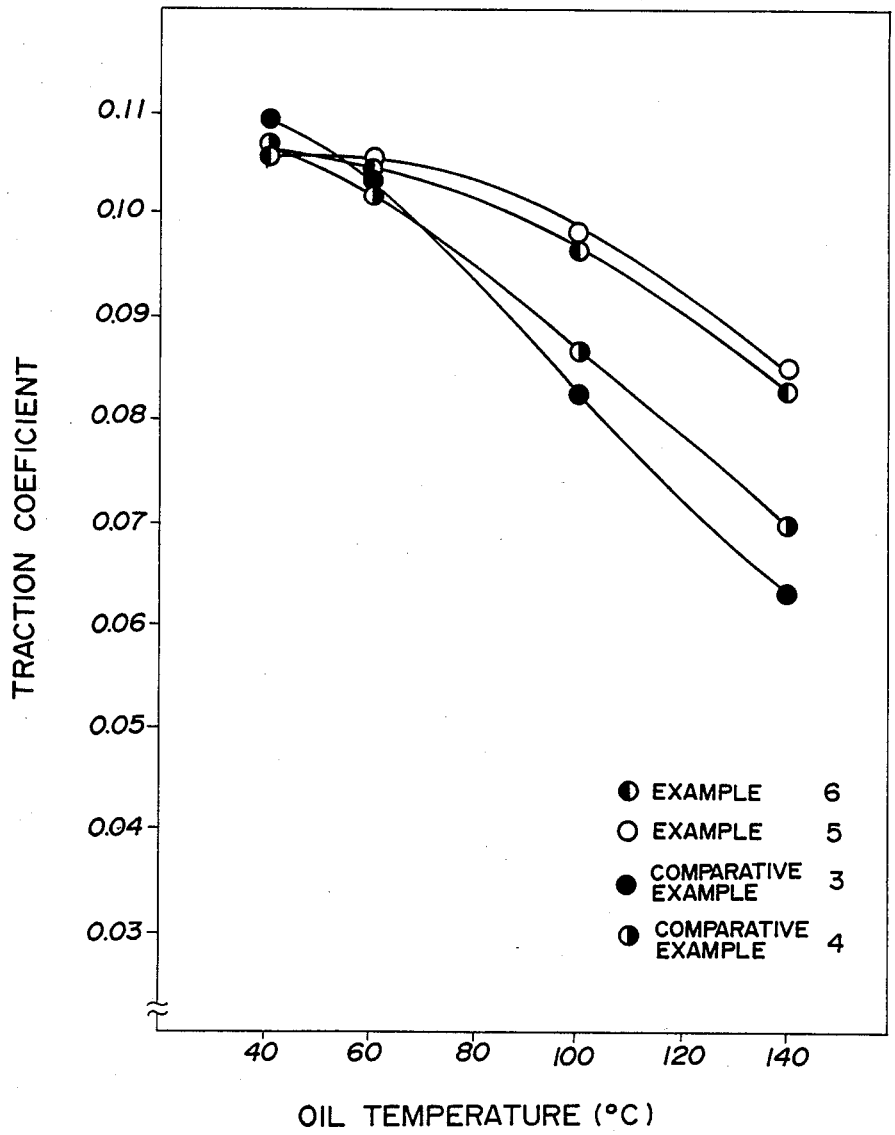
0.11
0.10
0.09
0.08
0.07
0.06
0.05
0.04
0.03
TRACTION COEFICIENT
40
60
80
100
120
140
OIL TEMPERATURE (°C)
EXAMPLE 6
EXAMPLE 5
COMPARATIVE EXAMPLE 3
COMPARATIVE EXAMPLE 4

FLUID COMPOSITION

BACKGROUND OF THE INVENTION

This invention relates to a novel fluid composition and a fluid for traction drive which contains this composition. More particularly, it relates to a fluid composition which contains o-tercyclohexyl compound and has good stability at low temperatures and a fluid for traction drive which contains this fluid composition.

Recently, traction driving devices using a fluid are used in place of the hitherto used gears as automatic transmission devices of rotary drive power in automobiles, etc., variable transmission devices of machines, constant speed transmission devices of aircraft parts and transmission devices of rotary drive power in land and water vehicles.

The fluids used for such traction driving devices are required to have characteristics such as smaller change between the properties under low temperature condition, e.g., at starting of engine and the properties (e.g., traction coefficient) under the subsequent high temperature condition.

Hitherto, mineral oils have been used as a fluid for traction drive, but use of synthetic oils have been proposed in view of the characteristics having high traction coefficient.

For example, Japanese Patent Publication (Kokoku) No.339/71 (corresponding to U.S. Pat. No. 3440894 of Monsanto Company) discloses an invention relating to a fluid for traction drive (tractant) wherein it is suggested that tercyclohexyl compound can be used as a traction drive. This tercyclohexyl compound has many isomers, most of which are solid at room temperature and so, when it is used as a fluid for traction drive, generally, a mixture of two or more of tercyclohexyl compounds is used as fluid composition.

However, according to the inventors' study, it has been found that when a fluid for tranction drive comprising a mixture of a plurality of tercyclohexyl compounds is stored for an extended period of time at low temperatures, crystals of tercyclohexyl compounds are separated.

Tercyclohexyl compounds can also be used as bases for lubricants, heat transfer oils, rust preventives, insulating oils, etc. in addition to as fluids for traction drive, but in this case, too, the existing crystals cause clogging of pipings and besides the properties are apt to change.

SUMMARY OF THE INVENTION

This invention has been made under the above circumstances.

That is, the first object of this invention is to provide a fluid composition from which crystals are not precipitated even if stored for a long time.

The second invention of this invention is to provide a fluid for traction drive from which crystals are not precipitated even if stored for a long time and furthermore shows little change of properties with increase of temperature.

This invention has been made for accomplishing these objects and summary of this invention is a fluid composition, characterized by containing a cis-o-tercyclohexyl compound and a trans-o-tercyclohexyl compound at a weight ratio of 25:75–65:35.

Further, summary of another invention is a fluid for traction drive which contains a fluid composition containing a cis-o-tercyclohexyl compound and a trans-o-tercyclohexyl compound at a weight ratio of 25:75–65:35.

BRIEF EXPLANATION OF THE DRAWING

FIG. 1 is a graph which shows the relation between temperatures and traction coefficient of fluids for traction drive.

DESCRIPTION OF THE INVENTION

The fluid composition of this invention contains a cis-o-tercyclohexyl compound and a trans-o-tercyclohexyl compound at a specific ratio.

These cis-o-tercyclohexyl compound and trans-o-tercyclohexyl compound have the following basic skeletons, respectively.

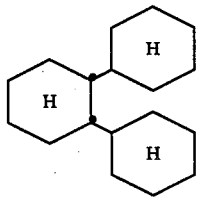

(Cis-o-tercyclohexyl compound)

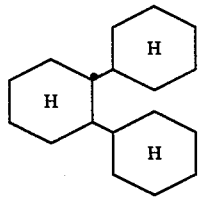

(trans-o-tercyclohexyl compound)

Considering heat resistance, it is preferred that the cis-o-tercyclohexyl compound and trans-o-tercyclohexyl compound which constitute components of the fluid composition of this invention have no substituents in the above skeletons, but they may have substituents.

When cis-o-tercyclohexyl compound and/or trans-o-tercyclohexyl compound have substituents, these substituents have no special limitation.

Examples of the substituents include alkyl groups of 1–3 carbon atoms (preferably one carbon atom) such as methyl group, ethyl group, propyl group and preferably methyl group.

The number of substituents is usually 5 or less.

When o-tercyclohexyl compounds having substituent of 4 or more carbon atoms and when o-tercyclohexyl compounds having 6 or more subtituents, heat resistance of the resulting fluid compositions sometimes deteriorates.

The o-tercyclohexyl compounds can be obtained, for example, by hydrogenation of o-terphenyl compounds in the presence of a catalyst. Cis-o-tercyclohexyl compound and trans-o-tercyclohexyl compound can be produced at high selectivities by changing the catalyst used for hydrogenation and the reaction conditions.

As catalysts used for production of cis-o-tercyclohexyl compound, mention may be made of, for example, ruthenium-carbon catalysts (content of ruthenium is normally 5% by weight), catalysts comprising metals such as platinum, rhodium, palladium and iridium supported on carriers (examples of carriers are active carbon, alumina, silica, silica alumina and diatomaceous earth and amount of the metal supported is 0.1–10% by weight, preferably 1–5% by weight).

Usually, reaction temperature is 200° C. or lower, preferably 70°–150° C., reaction pressure is 5 atm or higher, preferably 10–100 atm and reaction time is 10 minutes-10 hours.

For example, when ruthenium-carbon catalyst is used under the above reaction conditions, o-tercyclohexyl compounds obtained by hydrogenation of o-terphenyl compound usually contain 90% by weight or more of cis-isomer and production ratio of trans-isomer is normally 10% by weight or less.

Catalysts used for production of trans-o-tercyclohexyl compound include, for example, nickel-diatomaceous earth catalysts as supporting type catalyst and salts or complexes of nickel, palladium, platinum, rhodium, iridium, etc. as non-supporting type catalysts.

When supporting type catalysts are used, reaction temperature, reaction pressure and reaction time are normally 200° C. or higher, preferably 200°–300° C., 5 atm or higher, preferably 10–100 atm and 10 minutes-10 hours, respectively.

When non-supporting type catalysts are used, reaction temperature, reaction pressure and time are normally 0° C.–150° C., normal pressure-100 atm and 10 minutes-10 hours, respectively.

When the catalysts used in production of cis-o-tercyclohexyl compound are used, reaction temperature, reaction pressure and reaction time are normally higher than 200° C., 5 atm or higher, preferably 10–100 atm and 30 minutes-10 hours, respectively.

For example, nickel-diatomaceous earth catalyst is used, o-tercyclohexyl compounds obtained by hydrogenation of o-terphenyl compound ordinarily contain 90% by weight or higher of trans-isomer and production ratio of cis-isomer is ordinarily 10% by weight or less.

As disclosed in the patents referred to hereabove, tercyclohexyl compounds are suitable for fluids for traction drive as their general characteristics. The inventor of this invention has found that among them, o-tercyclohexyl compound is especially suitable.

However, when o-tercyclohexyl compounds containing both the cis-isomer and trans-isomer obtained by conventional processes are stored at low temperatures, crystals are separated therefrom. Therefore, o-tercyclohexyl compounds produced by conventional processes are difficult to use, for example, as fluids for traction drive.

The inventor of this invention has found that when cis-o-tercyclohexyl compound and trans-o-tercyclohexyl compound are mixed at a selected ratio, no crystals are separated even when the mixture is stored at low temperatures, That is, mixing ratio of cis-o-tercyclohexyl compound and trans-o-tercyclohexyl compound where crystals are not separated is 25:75–65:35 in weight ratio.

When the fluid composition of this invention comprising a mixture of the cis-isomer and the trans-isomer at a ratio within the above range is stored at a temperature lower than pour point (e.g., −20° C.) for a long time (e.g., 30 days), no crystals are separated and thus the fluid compositon of this invention contains substantially no crystals.

If the mixing ratio is outside the above range, crystals are separated out and the mixture is not suitable, for exmaple, as main component of fluids for traction drive.

The state of "substantially no crystals being contained" here means that crystals cannot be observed in fluid compositions by visual observation.

Fluids for traction drive containing this fluid composition have the tendency that traction coefficient does not readily decrease even if temperature increases.

Kinematic viscosity at 40° C. of the fluid composition of this invention is usually within the range of 37–42 cSt and kinematic viscosity at 100° C. is usually 4.2 cSt or less.

Specific gravity (15/4° C.) of the fluid composition of this invention is usually within the range of 0.942–0.947 and refractive index ($\eta_D^{20}$) thereof at 20° C. measured using D-line is normally within the range of 1.5035–1.5065. Pour point is normally −10° C. or lower.

The fluid composition of this invention which contains cis-o-tercyclohexyl compound and trans-o-tercyclohexyl compound at a specific ratio may additionaly contain other tercyclohexyl compounds in an amount within the range where the characteristics of the composition are not damaged. Content of the other tercyclohexyl compound is normally 50% by weight or less.

The fluid composition of this invention as such can be used as a fluid for traction drive, but it may further contain other components such as, for example, rust preventives, antioxidants, viscosity index improvers, antifoamers, fatigue resisting agents, detergent-dispersants, pour point depressants, extreme pressure additives, oiliness improvers and colorants.

Said antioxidants include, for exmaple, aromatic amine compounds, phenolic compounds, zinc dialkyldithiophosphates, phosphorus-sulfur compounds, sulfur compounds and phosphorus compounds.

Said rust preventives include, for example, organic compounds having polar groups such as salts of sulfonic acid, amines, organic acids, salts and esters thereof.

Said antifoamers include, for example, polymers of organosilicone compounds such as polymethylsiloxane.

Said viscosity index improvers include, for example, isobutylene polymers and methacrylate polymers.

Said pour point depressants include, for example, chlorinated parrafin naphthalene condensates and polymethacrylates.

The fluid composition of this invention can be produced in the form of liquid due to melting point depression by mixing cis-o-tercyclohexyl compound and trans-o-tercyclohexyl compound produced, for example, by the above mentioned process at a ratio within the range mentioned above.

Further, the fluid for traction drive according to this invention can be produced, if necessary, by adding the above additives such as rust preventives, antioxidants, etc. at or after preparation of the fluid composition.

The fluid for traction drive of this invention has usually a traction coefficient of 0.10 or more at 40° C., that of 0.095 or more at 100° C. and that of 0.08 or more at 140° C.

The above explanation has been made with reference to fluid for traction drive mainly composed of the fluid composition, it should be noted that the fluid composition of this invention can also be used as bases for heat transfer media, bases for rust preventives, electrical insulating oils, etc.

The fluid composition of this invention contains substantially no crystals. This can be attained by containing cis-o-tercyclohexyl compound and trans-O-tercyclohexyl compound at a ratio within a specific range.

Therefore, the fluid for traction drive which contains this fluid composition also contains substantially no crystals and hence, retains excellent characteristics even at low temperatures.

Furthermore, the fluid for traction drive of this invention is low in viscosity, has traction coefficient at low temperatures which is within the satisfactory range and shows no reduction of traction coefficient even at high temperatures.

Thus, drive power can be excellently transmitted by using the fluid for traction drive of this invention and hence, traction driving device can be made smaller and lighter than when conventional fluids for traction drive are employed.

This invention will be further illustrated by the following examples and comparative examples.

EXAMPLE 1

Production of a mixture of high cis-o-tercyclohexyl content:

200 g of o-terphenyl (manufactured by Tokyo Kasei Kogyo Co.), 6 g of 5% ruthenium-carbon catalyst (manufactured by Japan Engelhald co.) and 100 cc of cyclohexane were charged in an autoclave of 1 liter and hydrogenated for 3 hours under the conditions of hydrogen pressure 50 kg/cm$^2$ G and reaction temperature 130° C.

After cooling, the catalyst was removed by filtration and the solvent (cyclohexane) was distilled off to obtain 200 g of a white crystal.

The product was analyzed by NMR and gas chromatography to find that this white crystal was a mixture of 93% by weight of cis-o-tercyclohexyl and 7% by weight of trans-o-tercyclohexyl.

Production of a mixture of high trans-o-tercyclohexyl content:

200 g of o-terphenyl (manufactured by Tokyo Kasei Kogyo Co.), 6 g of nickel/diatomaceous earth catalyst (manufactured by Nikki Chemical Co.) and 100 cc of cyclohexane were charged in an autoclave of 1 liter and hydrogenated for 3 hours at a hydrogen pressure of 50 kg/cm$^2$ G and a temperature of 280° C.

After cooling, the catalyst was removed by filtration and the solvent (cyclohexane) was distilled off to obtain 200 g of a white crystal.

The product was analyzed by NMR and gas chromatography to find that this white crystal was a mixture of 93% by weight of trans-o-tercyclohexyl and 7% by weight of cis-o-tercyclohexyl.

Production of a mixed composition comprising a mixture of high cis-o-tercyclohexyl content and a mixture of high trans-o-tercyclohexyl content:

The above obtained mixture of high trans-o-tercyclohexyl content and the above obtained mixture of high cis-o-tercyclohexyl content were mixed so that weight ratio of trans-o-tercyclohexyl and cis-o-tercyclohexyl in the resulting fluid composition was 70:30 and the mixture was melted by heating to obtain a fluid composition.

EXAMPLE 2

A fluid composition was produced in the same manner as in Example 1 except that the mixture of high trans-o-tercyclohexyl content and the mixture of high cis-o-tercyclohexyl content were mixed so that the weight ratio of trans-o-tercyclohexyl and cis-o-tercyclohexyl in the resulting fluid composition was 60:40.

EXAMPLE 3

A fluid composition was produced in the same manner as in Example 1 except that the mixture of high trans-o-tercyclohexyl content and the mixture of high cis-o-tercyclohexyl content were mixed so that the weight ratio of trans-o-tercyclohexyl and cis-o-tercyclohexyl in the resulting fluid composition was 50:50.

EXAMPLE 4

A fluid composition was produced in the same manner as in Example 1 except that the mixture of high trans-o-tercyclohexyl content and the mixture of high cis-o-tercyclohexyl content were mixed so that the weight ratio of trans-o-tercyclohexyl and cis-o-tercyclohexyl in the resulting fluid composition was 40:60.

COMPARATIVE EXAMPLE 1

A fluid composition was produced in the same manner as in Example 1 except that the mixture of high trans-o-tercyclohexyl content and the mixture of high cis-o-tercyclohexyl content were mixed so that the weight ratio of trans-o-tercyclohexyl and cis-o-tercyclohexyl in the resulting fluid composition was 80:20.

COMPARATIVE EXAMPLE 2

A fluid composition was produced in the same manner as in Example 1 except that the mixture of high trans-o-tercyclohexyl content and the mixture of high cis-o-tercyclohexyl content were mixed so that the weight ratio of trans-o-tercyclohexyl and cis-o-tercyclohexyl in the resulting fluid composition was 30:70.

EVALUATION

Kinematic viscosities at 40° C. and 100° C., specific gravity (15/4° C.), refractive index ($\eta_D^{20}$) at 20° C. measured using D-line and pour point of thus obtained fluid compositions are shown in Table 1.

Moreover, these fluid compositions were left to stand at −20° C. for 30 days and separation of crystals was observed. The results are also shown in Table 1.

TABLE 1

| | Comparative Example 1 | Example 1 | Example 2 | Example 3 | Example 4 | Comparative Example 2 |
|---|---|---|---|---|---|---|
| Ratio of trans/cis isomers | 80/20 | 70/30 | 60/40 | 50/50 | 40/60 | 30/70 |
| Kinematic viscosity | | | | | | |
| 40° C.(cSt) | 42.06 | 41.09 | 40.32 | 39.23 | 37.91 | 36.59 |
| 100° C.(cSt) | 4.078 | 4.128 | 4.164 | 4.193 | 4.194 | 4.191 |
| Specific gravity 15/4° C. | 0.9406 | 0.9422 | 0.9439 | 0.9453 | 0.9461 | 0.9560 |
| Refractive index $D^{20}$ | 1.5032 | 1.5040 | 1.5048 | 1.5055 | 1.5062 | 1.5068 |
| Pour point (°C.) | − 15.0 | − 15.0 | − 17.5 | − 17.5 | − 20.0 | − 22.5 |
| Separation of Crystal | Occurred | not Occurred | not Occurred | not Occurred | not Occurred | Occurred |

It is recognized from Table 1 that even if the fluid composition of this invention is left to stand at low temperatures for a long time, no separation of crystals occurs and thus the composition is stable.

EXAMPLE 5

The fluid composition obtained in Example 1 was used as a fluid for traction drive and traction coefficient of this fluid for traction drive was measured by the following method.

METHOD OF MEASUREMENT

One of cylinders of same size which contact with each other (diameter: 52 mm and thickness: 6 mm; one to be drived is in the form of a drum of 10 mm in curvature radius and another to drie is of the flat type with no crowning) is rotated at a given speed (1500 rpm) and another is continuously rotated at 1500–1750 rpm and a load of 7 kg is applied to the contacting portion of both cylinders by a spring. Tangential force generated between both the cylinders, namely, traction force is measured and traction coefficient is obtained. These cylinders are made of bearing steel SUJ-2 of mirror finish and maximum hertzian contact pressure is 112 kg/mm$^2$.

Measurement of relation between traction coefficient and oil bath temperature is carried out by changing the temperature from 40° C. to 140° C. by heating the oil tank by a heater and measuring the relation at a slip ratio of 5%. The results are shown in FIG. 1.

The traction coefficient in the examples and comparative examples were measured by the above method.

EXAMPLE 6

The fluid composition obtained in Example 2 was used as a fluid for traction drive and traction coefficient of this fluid for traction drive was measured by the method mentioned in Example 5. The results are shown in FIG. 1.

COMPARATIVE EXAMPLE 3

1000 g of α-methylstyrene, 40 g of acid clay and 50 g of mesityl oxide were charged in a glass flask of 3 liters and reacted at 140° C. for 2 hours with stirring. The catalyst was removed by filtration from reaction mixture and then unreacted α-methylstyrene and mesityl oxide were distilled off to obtain 900 g of a fraction having a boiling point of 125°–130° C. (0.2 mmHg).

This fraction was analyzed by NMR and gas chromatography to find that this was a mixture of 97% by weight of a linear dimer of α-methylstyrene and 3% by weight of a cyclic dimer of α-methylstyrene.

This fraction was hydrogenated by the same method as in Example 1 to obtain a fluid for traction drive mainly composed of 2,4-dicyclohexyl-2-methylpentane.

This fluid for traction drive had a specific gravity of 0.90 (15/4° C.), a kinematic viscosities of 20.27 cSt (40° C.) and 3.580 cSt (100°) and a viscosity index of 13.

Traction coefficients of this fluid at 40°–140° C. are shown in FIG. 1.

COMPARATIVE EXAMPLE 4

The mixture of high cis-o-tercyclohexyl content obtained in Example 1 was used as a fluid for traction drive and traction coefficients at 40°–140°C. were measured.

The results are shown in FIG. 1.

It is recognized from FIG. 1 that the fluid for traction drive of this invention is less in reduction of traction coefficient with increase in temperature. Therefore, transmission efficiecy of drive power is improved and thus it becomes possible to make the size of traction driving device smaller by using the fluid for traction drive of this invention.

What is claimed is:

1. In a traction drive containing a tractant, the improvement which comprises using as the tractant a fluid composition which contains a cis-o-tercyclohexyl compound and a trans-o-tercyclohexyl compound at a weight ratio within the range of 25:75 to 65:35.

2. A traction drive according to claim 1 wherein the cis-o-tercyclohexyl compound has 5 or less lower alkyl groups of 1–3 carbon atoms as substituents in cyclohexyl ring.

3. A traction drive according to claim 1 wherein the cis-o-tercyclohexyl compound has 5 or less methyl groups in cyclohexyl ring.

4. A traction drive according to claim 1 wherein the cis-o-tercyclohexyl compound is cis-o- tercyclohexyl and the trans-o-tercyclohexyl compound is trans-o-tercyclohexyl.

5. A traction drive according to claim 1 wherein the cis-o-tercyclohexyl compound is obtained by hydrogenation of an o-terphenyl compound at a temperature of 200° C. or lower in the presence of a ruthenium-carbon catalyst.

6. A traction drive according to claim 1 wherein the trans-o-tercyclohexyl compound is obtained by hydrogenation of an o-terphenyl compound at a temperature of 200° C. or higher in the presence of a nickel-diatomaceous earth catalyst.

* * * * *